US011328883B2

(12) United States Patent
Shimazu et al.

(10) Patent No.: US 11,328,883 B2
(45) Date of Patent: May 10, 2022

(54) SWITCH DEVICE

(71) Applicants: HONDA MOTOR CO., LTD., Tokyo (JP); TOYO DENSO CO., LTD., Tokyo (JP)

(72) Inventors: Yoshinobu Shimazu, Wako (JP); Yuki Kuno, Wako (JP); Taiji Okawa, Wako (JP); Kouji Yamazaki, Tsurugashima (JP); Hiroyuki Abe, Tsurugashima (JP); Mitsuhiro Kondo, Tsurugashima (JP)

(73) Assignees: Honda Motor Co., Ltd., Tokyo (JP); Toyo Denso Co., Ltd., Tokyo (JP)

( * ) Notice: Subject to any disclaimer, the term of this patent is extended or adjusted under 35 U.S.C. 154(b) by 0 days.

(21) Appl. No.: 17/173,551

(22) Filed: Feb. 11, 2021

(65) Prior Publication Data

US 2021/0296065 A1 Sep. 23, 2021

(30) Foreign Application Priority Data

Mar. 18, 2020 (JP) ..... JP2020-047752

(51) Int. Cl.
*H01H 21/22* (2006.01)
*H01H 21/08* (2006.01)

(52) U.S. Cl.
CPC ..... *H01H 21/22* (2013.01); *H01H 21/08* (2013.01); *H01H 2021/225* (2013.01); *H01H 2300/01* (2013.01)

(58) Field of Classification Search
CPC ... H01H 21/22; H01H 21/08; H01H 2021/225
USPC ..... 200/341, 339, 343, 315, 600, 553
See application file for complete search history.

(56) References Cited

U.S. PATENT DOCUMENTS 6,191,372 B1 2/2001 Sasaki et al.

FOREIGN PATENT DOCUMENTS

| | | | |
|---|---|---|---|
| JP | 2000-348569 | A | 12/2000 |
| JP | 2003-216303 | A | 7/2003 |
| JP | 2010-055981 | A | 3/2010 |

*Primary Examiner* — Edwin A. Leon
*Assistant Examiner* — Iman Malakooti
(74) *Attorney, Agent, or Firm* — Carrier Blackman & Associates, P.C.; William D. Blackman; Joseph P. Carrier

(57) ABSTRACT

In a switch device, a switch part is turned ON/OFF by operation of an operating knob housed in a recessed part of a panel so that a movable terminal and a fixed terminal are in contact or are separated. An outside face, opposing an inner peripheral face of the recessed part of the panel, of the operating knob is an inclined face that is inclined inward of the operating knob in going downward. A gap that widens in going downward is formed between the outside face of the operating knob and the inner peripheral face of the recessed part of the panel. Accordingly, the device can ensure stable operation of the operating knob by discharging, from the gap between the panel and the operating knob, liquid that has entered the gap, and that can improve the appearance.

11 Claims, 7 Drawing Sheets

SWITCH DEVICE

BACKGROUND OF THE INVENTION

Field of the Invention

The present invention relates to a switch device in which a switch part is turned ON/OFF by the operation of an operating knob housed in a panel so that a movable terminal and a fixed terminal are in contact or are separated.

Description of the Related Art

For example, a push switch is one in which a switch part is turned ON by an operating knob being pushed down so as to put a movable electrode and a fixed electrode into contact with each other and electrically connect the two, and various proposals have been made with regard to the push switch (for example, Japanese Patent Application Laid-open Nos. 2003-216303, 2010-055981, and 2000-348569).

In such a push switch, a panel 101 and an operating knob 111 shown in sectional view in FIG. 7 are formed by injection molding a resin, and in order to enable them to be released from a mold (a fixed mold and a movable mold) at the time of injection molding, an inner peripheral face 101*a* of a recess part 101A, housing the operating knob 111, of the panel 101 and an outer peripheral face 111*a* of the operating knob 111 opposing the inner peripheral face 101*a* have draft angles formed thereon that are in opposite directions from each other. Specifically, formed on the inner peripheral face 101*a* of the recess part 101A of the panel 101 is a draft angle in an orientation so that an opening area of the recess part 101A narrows in going downward, and formed on the outside face 111*a* of the operating knob 111 is a draft angle in an orientation so that the width of the operating knob 111 increases in going downward.

A gap A having a width that narrows in going downward is therefore formed between the inner peripheral face 101*a* of the recess part 101A of the panel 101 and the outside face 111*a* of the operating knob 111.

However, as shown in FIG. 7, when the gap A, which narrows in going downward, is formed between the inner peripheral face 101*a* of the recess part 101A of the panel 101 and the outside face 111*a* of the operating knob 111, for example, when a liquid such as a drink having a high sugar content is spilled and enters the gap A between the panel 101 and the operating knob 111, the liquid thus entering cannot pass through the gap A and builds up in the gap A; for example, when the liquid that has built up therein dries, the sugar content therein solidifies and the operating knob 111 sticks to the panel 101, and it takes a long time for the operating knob 111 to return, there thus being room for improvement in terms of ease of operation.

In contrast to this, as disclosed in Japanese Patent Application Laid-open Nos. 2003-216303 and 2010-055981 a gap is provided at the lower end of a portion of the panel that opposes the operating knob, but this is not sufficient.

Furthermore, since the gap A between the panel 101 and the operating knob 111 becomes large on the upper face side where it is conspicuous, the appearance of the push switch is impaired, which is a problem.

This problem may occur also in a push switch proposed in Japanese Patent Application Laid-open Nos. 2003-216303 and 2010-055981 or a rocker switch proposed in Japanese Patent Application Laid-open No. 2000-348569.

SUMMARY OF THE INVENTION

The present invention has been accomplished in light of the above problems, and it is an object thereof to provide a switch device that can ensure stable operation of an operating knob by discharging, from a gap between a panel and the operating knob, liquid that has entered the gap, and that can improve the appearance.

In order to achieve the object, according to an aspect of the present invention, there is provided a switch device comprising an operating knob including, on an outside face thereof opposing an adjacent member adjacent to the operating knob, an inclined part that is inclined toward an inside direction of the operating knob in going substantially in a direction of gravity.

In accordance with the aspect of the present invention, since the operating knob includes, on the outside face opposing the adjacent member adjacent to the operating knob, the inclined part that is inclined toward the inside direction of the operating knob in going substantially in the direction of gravity, the gap formed between the outside face of the operating knob and the adjacent member widens in going toward the direction of gravity. Because of this, even when a liquid such as a drink having a high sugar content is spilled and enters the gap, the liquid thus entering the gap heads downward and is discharged without building up in the gap. Therefore, the occurrence of the conventional problem that the sugar content in a liquid that has built up in the gap solidifies and causes the operating knob and the adjacent member to stick together can be suppressed. Furthermore, since the gap formed between the outside face of the knob and the inner peripheral face of the recessed part of the adjacent member narrows in width in going upward, this width becomes a minimum on the uppermost face (exterior face) where it is conspicuous, and the appearance of the switch device is enhanced.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention is explained below by reference to the attached drawings.

Figure 1:
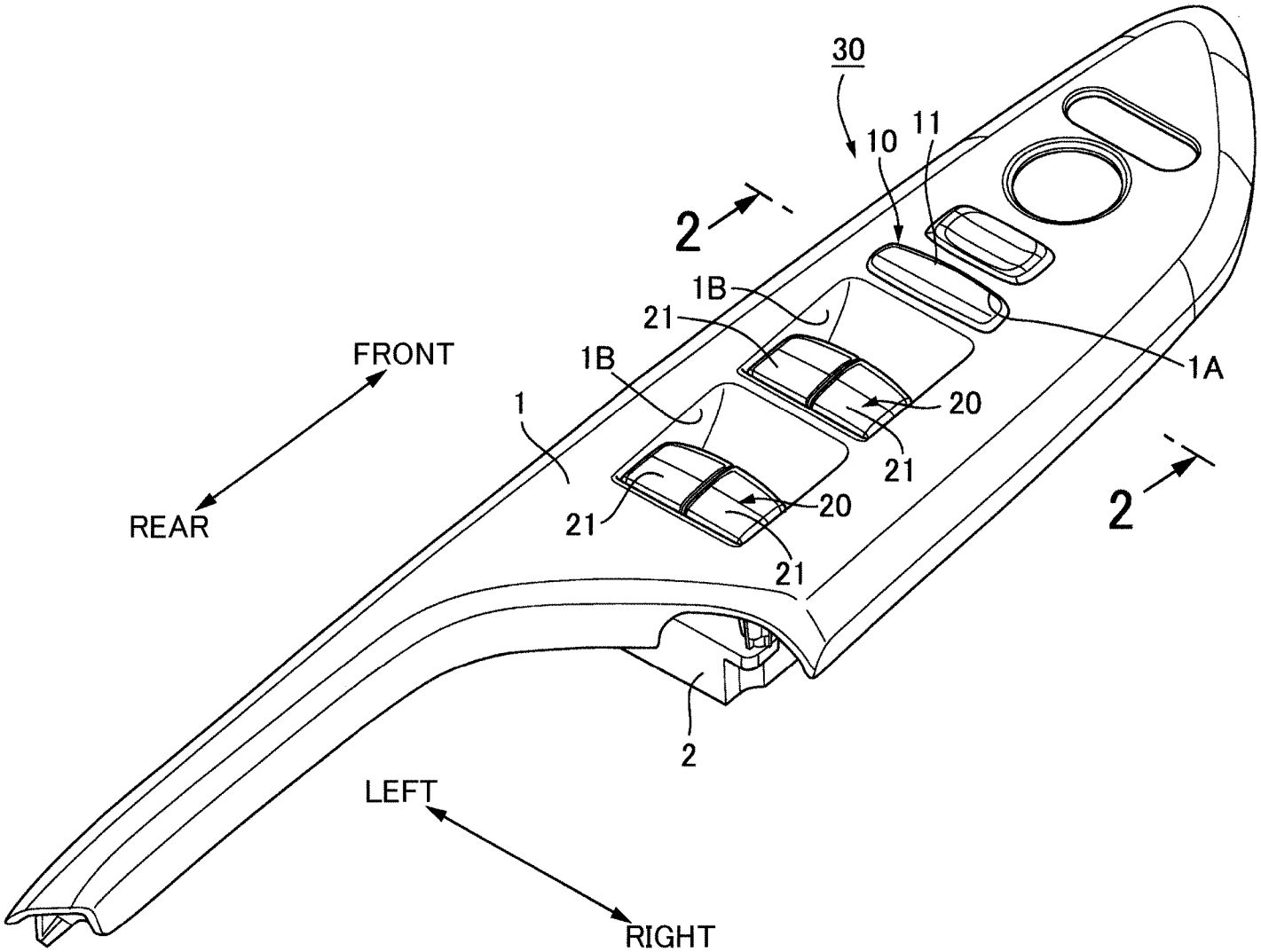
FIG. 1 is a perspective view of a vehicle switch operating part equipped with a switch device related to an embodiment of the present invention.
Figure 2:
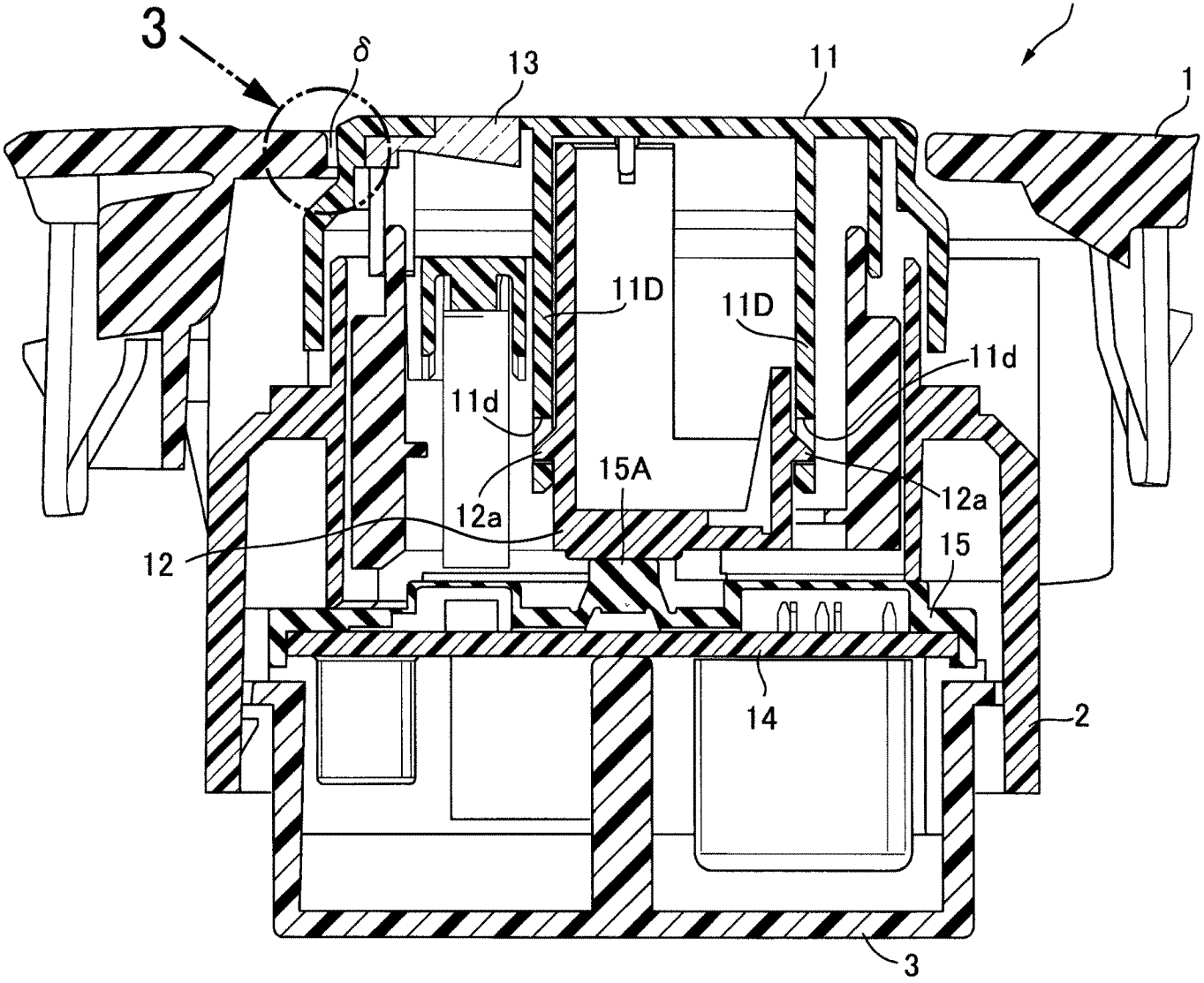
FIG. 2 is a sectional view along line 2-2 in FIG. 1.
Figure 3:
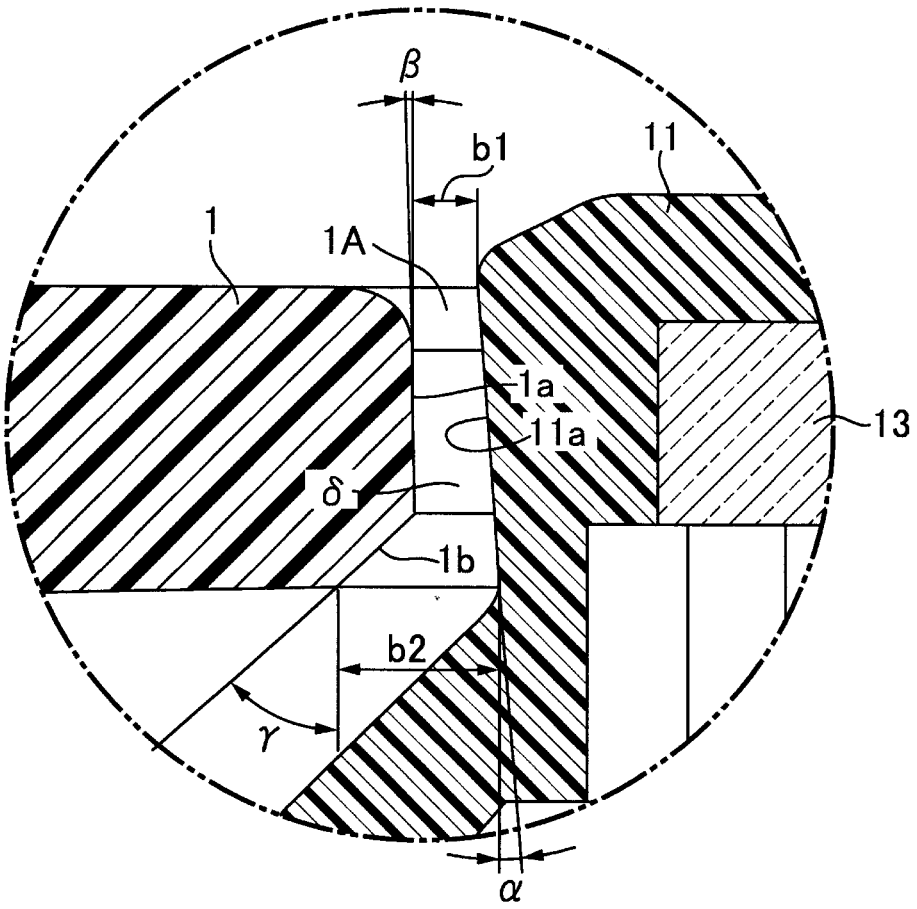
FIG. 3 is an enlarged detailed view of part 3 in FIG. 2.
Figure 4:
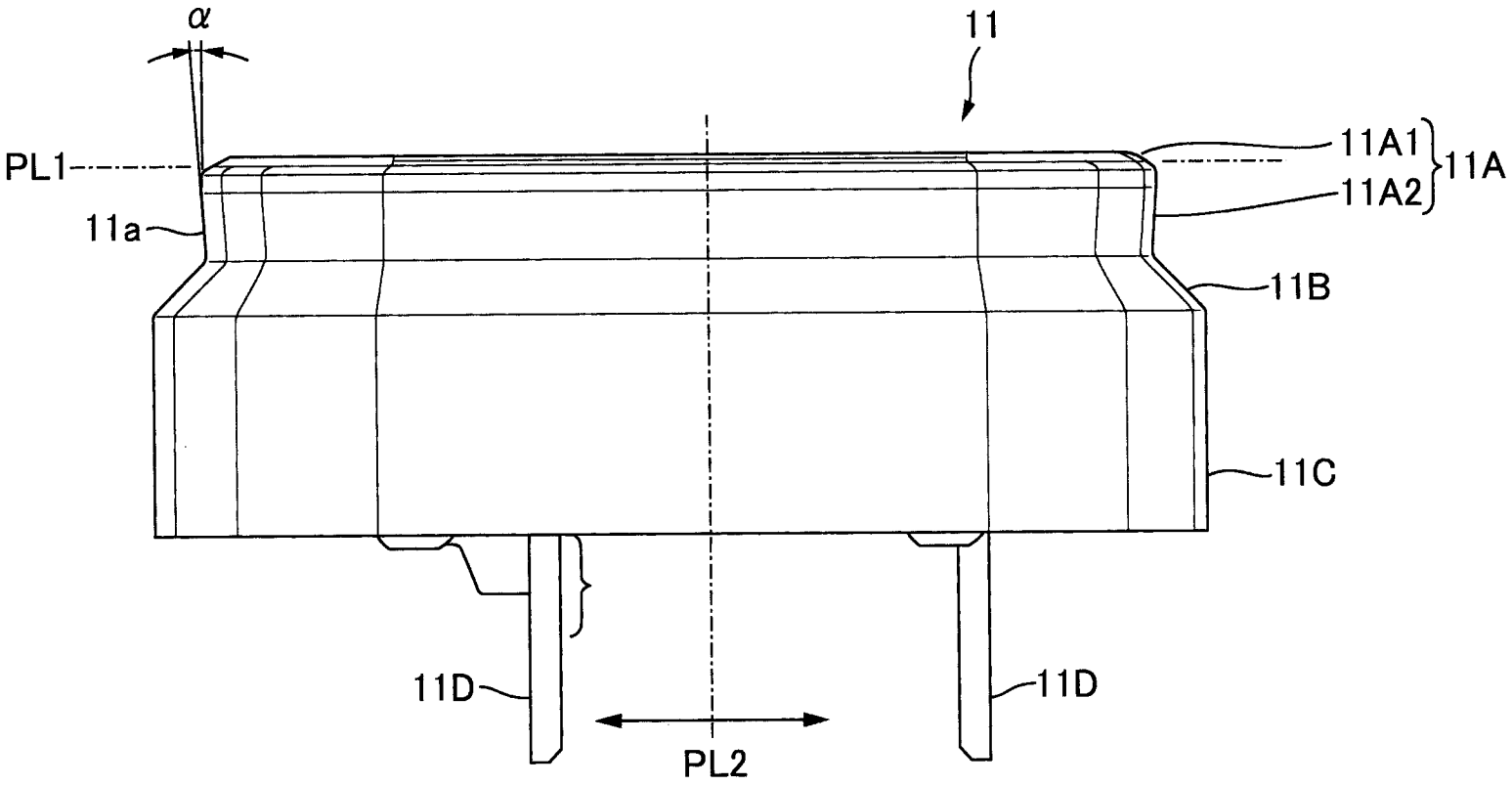
FIG. 4 is a front view of an operating knob of the switch device related to the present embodiment.
Figure 5:
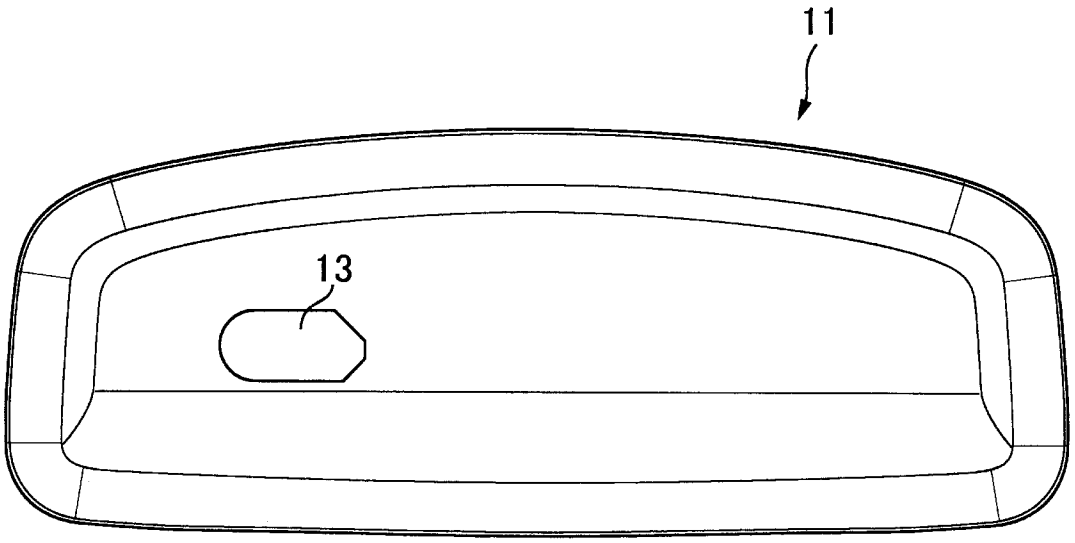
FIG. 5 is a plan view of the operating knob of the switch device related to the present embodiment.
Figure 6:
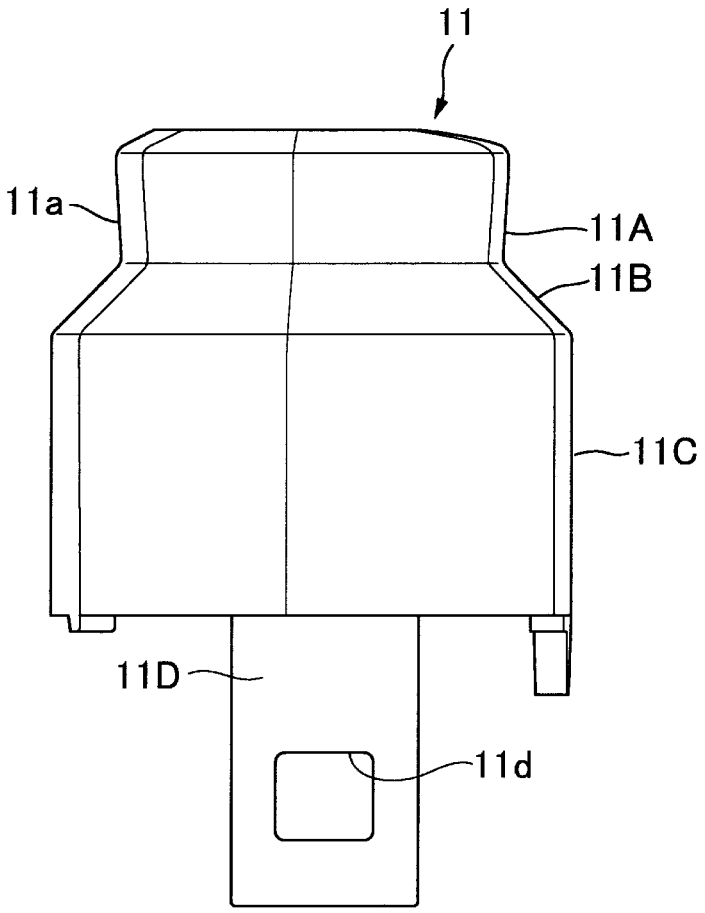
FIG. 6 is a side view of the operating knob of the switch device related to the present embodiment.
Figure 7:
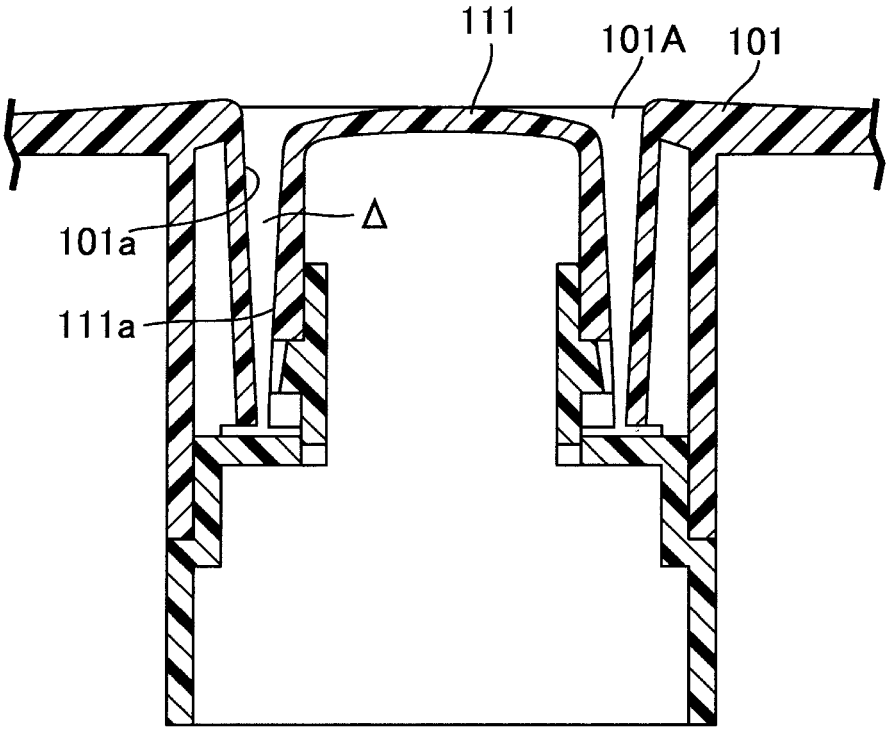
FIG. 7 is a sectional view of an operating knob and a panel of a conventional switch device.

FIG. 1 is a perspective view of a vehicle switch operating part equipped with a switch device related to the present embodiment, FIG. 2 is a sectional view along line 2-2 in FIG. 1, FIG. 3 is an enlarged detailed view of part 3 in FIG. 2, FIG. 4 is a front view of an operating knob of the switch device related to the present embodiment, FIG. 5 is a plan view of the operating knob, and FIG. 6 is a side view of the operating knob.

A switch operating part 30 shown in FIG. 1 is for operating a power window device, which is not illustrated, that raises and lowers a door window of a vehicle by electrical power, and it is disposed on an inner face of a vehicle door (one disposed on a left door being illustrated as one example).

The switch operating part 30 shown in FIG. 1 is equipped with a narrow panel 1 that is long in the vehicle fore-and-aft direction, and a case 2 housing various types of components is mounted beneath the panel 1. Formed in the panel 1 on the vehicle front side is a narrow recessed part 1A having a substantially rectangular shape that is long in the lateral direction (left-and-right direction), and housed in the recessed part 1A is a narrow push switch 10 having a substantially rectangular shape that is similarly long in the lateral direction in plan view so that it can be operated by being pushed down. In the present embodiment, the panel 1 and the case 2 are formed by injection molding a resin. The push switch 10 is a lock switch that prohibits the raising and lowering of the door window when a switch operating member 20 is operated, and serves as a switch device.

Two rectangular recessed parts 1B are formed on the front and rear to the rear of the recessed part 1A of the panel 1 in the vehicle, and these recessed parts 1B each house two rocker switches 21 arranged laterally side-by-side and having a substantially rectangular shape in plan view. These rocker switches 21 are for raising and lowering the door window by end parts of the rocker switches 21 being pulled up or pushed down.

The push switch 10 forming the switch device related to the present embodiment is now explained.

As shown in FIG. 2, the push switch 10 includes an operating knob 11 as an operating part facing the recessed part 1A of the panel 1, and an angular tubular pressing member 12 is disposed on the inside of the lower part of the operating knob 11. As shown in FIG. 2, FIG. 4, and FIG. 6, two rectangular plate-shaped brackets 11D extending integrally from a top face part downward in the vertical direction are projectingly provided on the operating knob 11 so as to be parallel to each other, and rectangular engagement holes 11*d* (see FIG. 2 and FIG. 6) are formed in lower parts of the brackets 11D respectively. On the other hand, engagement claws 12*a* are integrally and projectingly provided at two locations on the left and right respectively of the pressing member 12 (two locations opposing the engagement holes 11*d* formed in the two brackets 11D respectively of the operating knob 11) as shown in FIG. 2, and due to these engagement claws 12*a* engaging with the engagement holes 11*d* respectively formed in the two brackets 11D of the operating knob 11 from the inside, the operating knob 11 and the pressing member 12 are linked together. In the present embodiment, an arrangement is employed in which the operating knob 11 and the pressing member 12 are formed as separate members and the two are linked together, but the operating knob 11 and the pressing member 12 may be formed as a unit.

In the present embodiment, the operating knob 11 and the pressing member 12 are formed by injection molding a resin, and the operating knob 11 is formed by integrally superimposing in three steps three portions 11A, 11B, 11C in the up-down direction (height direction) having different widths as shown in FIG. 4 and FIG. 6. Specifically, the operating knob 11 includes an upper step portion 11A (first inclined part) having the smallest width, a middle step portion 11B (second inclined part) having a width that widens in a tapered shape in going downward from the upper step portion 11A, and a lower step portion 11C having a wide skirt shape extending vertically downward from the middle step portion 11B.

In the upper step portion 11A, as shown in FIG. 4, with a parting line PL1 as a border, an outside face of a portion 11A1 higher up than the parting line PL1 is an inclined face that is inclined inward of the operating knob 11 so that the width narrows in going upward, and an outside face 11*a* of a portion 11A2 lower down than the parting line PL1 is an inclined face that is inclined inward of the operating knob 11 so that the width narrows in going downward. Specifically, the outside face 11*a* of the portion 11A2, lower down than the parting line PL1, of an upper end part of the operating knob 11 is an inclined face that is inclined only by an angle $\alpha$ as illustrated with respect to a vertical plane.

As shown in FIG. 2 and FIG. 5, embedded in part of the top face part of the operating knob 11 is a translucent member 13 that transmits light emitted from an illumination device, which is not illustrated, emitting light at night.

It is impossible, because of undercut, to injection mold the knob 11 equipped with the upper step portion 11A arranged as described above using a conventional fixed mold and movable mold that are split into two molds in the up-down direction. Because of this, conventionally, the outside face 11*a* of the portion 11A2 lower down than the parting line PL1 is not inclined inward, but in the present embodiment, as shown in FIG. 4, the outside face 11*a* of the portion 11A2, lower down than the parting line PL1, of the upper step portion 11A of the operating knob 11 is molded by the use of sliding molds that are split into left and right molds by a parting line PL2 in the longitudinal direction passing the center in the left-and-right direction of the operating knob 11, and it is therefore possible to make the outside face 11*a* be inclined inward of the operating knob 11. The outer face of the portion 11A1, higher up than the parting line PL1, of the upper step portion 11A of the operating knob 11 is molded using a mold (fixed mold or movable mold) that can be pulled out upward after molding.

On the other hand, since the panel 1 is molded using a fixed mold and a movable mold that are split into two in the up-down direction as in the conventional manner, the inner peripheral face 1*a* (inner peripheral face opposing the outside face 11*a* of the operating knob 11) of the recessed part 1A of the panel 1 is an inclined face that is inclined, as shown in detail in FIG. 3, in a direction in which an opening area of the recessed part 1A reduces in going downward, while taking into consideration the draft angle of the mold. Specifically, the inner peripheral face 1*a* of the recessed part 1A of the panel 1 is inclined toward the center of the recessed part 1A only by an angle $\beta$ as illustrated with respect to a vertical plane in going downward.

Here, in the present embodiment, the inclination angle $\beta$ of the inner peripheral face 1*a* of the recessed part 1A of the panel 1 is set to be smaller than the inclination angle $\alpha$ of the inclined face formed on the outside face 11*a* of the upper step portion 11A of the operating knob 11 ($\beta<\alpha$). Because of this, as shown in FIG. 3, formed between the inner peripheral face 1*a* of the recessed part 1A of the panel 1 and the outside face 11*a* of the upper step portion 11A of the operating knob 11 opposing the inner peripheral face 1*a* is a gap $\delta$ that widens in going downward (in a direction in which the operating knob 11 is pushed down) (in other words, the inclined part formed on the inner peripheral face 1*a* of the side face of the panel 1 opposing the outside face 11*a* of the operating knob 11 forms the gap $\delta$ having a width that widens in going substantially in the direction of gravity of the operating knob 11 between itself and the outside face 11*a* of the operating knob 11).

In the present embodiment, as shown in FIG. 3, a cut face 1*b* that spreads in a tapered shape in going downward is formed at the lower edge part of the inner peripheral face 1*a* of the recessed part 1A of the panel 1. The cut face 1*b* is inclined only by an inclination angle γ as illustrated with respect to a vertical plane, and in the present embodiment it is set so that γ=45°. Since the cut face 1*b* is thus inclined at the lower edge part of the inner peripheral face 1*a* of the recessed part 1A of the panel 1, the gap δ formed between the inner peripheral face 1*a* of the recessed part 1A of the panel 1 and the outside face 11*a* of the upper step portion 11A of the operating knob 11 spreads rapidly in width in the lower end part, the width of the gap δ being a minimum value b1 at the upper end and a maximum value b2 (>b1) at the lower end.

In the present embodiment, the outside face 11*a* of the upper step portion 11A of the operating knob 11 is an inclined face over the entire periphery, and the gap δ, which widens in going downward, is formed between the outside face 11*a* of the operating knob 11 and the inner peripheral face 1*a* of the recessed part 1A of the panel 1 over the entire peripheries of the outside face 11*a* of the operating knob 11 and the inner peripheral face 1*a* of the recessed part 1A of the panel 1.

On the other hand, as shown in FIG. 2, a substrate 14 is placed horizontally beneath the pressing member 12, and a rubber contact 15 is disposed between the substrate 14 and the pressing member 12, the rubber contact 15 being formed from an elastic member such as a rubber and being capable of flexing. A projection-shaped pressing part 15A is formed integrally with a central part of the rubber contact 15, an upper face of the pressing part 1A abuts against the pressing member 12, and a movable contact, which is not illustrated, is provided on a lower face of the pressing part 15A. A fixed contact, which is not illustrated, is provided on a central part of the substrate 14, the fixed contact making contact selectively with the movable contact provided on the pressing part 15A of the rubber contact 15.

As shown in FIG. 2, various types of components such as the pressing member 12, the substrate 14, and the rubber contact 15 are housed within the tubular case 2, and an opening in a lower face of the case 2 is covered by a bottomed tubular cover 3. The case 2 and the cover 3 are formed by injection molding a resin.

When an occupant pushes down the rocker switch 21 disposed on the panel 1 of the switch operating part 30 shown in FIG. 1 so as to make it rock downward, the door window is electrically lowered by the power window device, which is not illustrated, and when the rocker switch 21 is pulled up so as to make it rock upward, the door window is electrically raised by the power window device, which is not illustrated.

The push switch 10 explained above functions as a lock switch, and when an occupant pushes the operating knob 11 once, the pressing member 12 linked to the operating knob 11 is lowered together with the operating knob 11, and presses the pressing part 15A of the rubber contact 15. As a result, the rubber contact 15 undergoes elastic deformation, the pressing part 15A is pushed down, the movable contact, which is not illustrated, provided thereon makes contact with the fixed contact, which is not illustrated, provided on the substrate 14, the two are electrically connected, and the lock function is turned ON; even if the rocker switch 21 is operated, raising and lowering of the door window is prohibited, and even when the rocker switch 21 is operated by a child, etc. the operation is ineffective and the door window will not be raised or lowered inadvertently, thus ensuring high safety.

After the operating knob 11 of the push switch 10 is pushed once as described above, the operating knob 11 is returned to the original position by means of an elastic restoring force of the rubber contact 15; when the operating knob 11 in this state is pushed again, as described above the movable contact makes contact with the fixed contact, the two are electrically connected, the lock function is turned OFF, and the prohibition of raising and lowering of the door window by the power window device is released. It is thereby possible to electrically raise and lower the door window by operating the rocker switch 21.

As described above, in the present embodiment, the operating knob 11 of the push switch 10 includes an inclined part on the outside face 11*a*, opposing the inner peripheral face 1*a* of the recessed part 1A of the panel 1, which is an adjacent member that is adjacent to the operating knob 11, the inclined part being inclined inward of the operating knob 11 in going toward substantially the direction of gravity, the gap δ formed between the outside face 11*a* of the operating knob 11 and the inner peripheral face 1*a* of the recessed part 1A of the panel 1 therefore widens in going toward the direction of gravity (downward), and even when a liquid such as a drink having a high sugar content is spilled and enters the gap δ, the liquid thus entering the gap δ heads downward and is discharged without building up in the gap δ. Because of this, the occurrence of the conventional problem that the sugar content in a liquid that has built up in the gap δ solidifies and causes the operating knob 11 and the panel 1 to stick together can be suppressed.

Furthermore, since the gap δ formed between the outside face 11*a* of the operating knob 11 and the inner peripheral face 1*a* of the recessed part 1A of the panel 1 narrows in width in going upward, this width becomes a minimum on the uppermost face (exterior face) where it is conspicuous, and the appearance of the push switch 10 is enhanced.

In particular, in the present embodiment, since the inner peripheral face 1*a* of the recessed part 1A of the panel 1 is an inclined face that is inclined in a direction in which the opening area of the recessed part 1A decreases in going downward, and the inclination angle β of the inclined face is set to be smaller than the inclination angle α of the inclined face formed on the outside face 11*a* of the operating knob 11 (β<α), the gap δ formed between the outside face 11*a* of the operating knob 11 and the inner peripheral face 1*a* of the recessed part 1A of the panel 1 reliably widens in going downward, and the effect can be obtained reliably.

In the present embodiment, since the cut face 1*b* having an inclination angle γ (=45°) and widening in a tapered shape in going downward is formed at the lower edge part of the inner peripheral face 1*a* of the recessed part 1A of the panel 1, the lower end part of the gap δ formed between the inner peripheral face 1*a* of the recessed part 1A of the panel 1 and the outside face 11*a* of the operating knob 11 has a width b2 that is further increased by means of the cut face 1*b*. Because of this, liquid entering the gap δ is more efficiently discharged via the gap δ, sticking of the operating knob 11 to the panel 1 can be more reliably prevented, and stable operation of the operating knob 11 becomes possible.

Furthermore, in the present embodiment, since the outer peripheral face 11*a*, opposing the inner peripheral face 1*a* of the recessed part 1A of the panel 1, of the operating knob 11 is an inclined face over the entire periphery, and the gap δ, which widens in going downward, is formed between the outside face 11*a* of the operating knob 11 and the inner peripheral face 1*a* of the recessed part 1A of the panel 1 over the entire peripheries of the outside face 11*a* of the operating knob 11 and the inner peripheral face 1*a* of the recessed part 1A of the panel 1, liquid entering the gap δ is more reliably discharged via the gap δ, thus enabling the operating knob 11 to be stably operated, the gap between the operating knob 11 and the panel 1 can be formed uniformly, and an effect of further enhancing the appearance of the push switch 10 can be obtained.

Furthermore, due to the middle step portion 11B widening in a tapered shape in going downward from the upper step portion 11A being provided, an effect of enabling the liquid entering the gap δ to be discharged via the gap δ while suppressing the entry of liquid into the interior of the case 2 can be obtained.

Moreover, due to the angle formed by the cut face 1*b* with respect to the direction of gravity being larger than the angle formed by the middle step portion 11B with respect to the direction of gravity, the gap δ, which widens in going downward, can be formed while providing the middle step portion 11B, and an effect of enabling the liquid to be more efficiently discharged via the gap δ can be obtained.

A mode in which the present invention is applied to a push switch for locking the electrical raising and lowering of a door window by means of a power window device is explained above, but the present invention may be applied not only to any other push switch but also to a rocker switch in the same manner.

An embodiment of the present invention is explained above, but the present invention is not limited to the above-mentioned embodiment and may be modified in a variety of ways as long as the modifications do not depart from the gist of the present invention.

What is claimed is:

1. A switch device comprising:

an operating knob including, on an outside face thereof opposing a adjacent member adjacent to the operating knob, a first inclined part that is inclined toward an inside direction of the operating knob in going substantially downwardly toward a direction of gravity, wherein the adjacent member has an inclined part provided on a side face opposing the outside face of the operating knob, and forms, between the outside face of the operating knob and the adjacent member, a gap that widens as it extends downwardly.

2. The switch device according to claim 1, wherein the operating knob further comprises a second inclined part having a width that widens in a tapered manner as it extends downwardly.

3. The switch device according to claim 1, wherein the operating knob opposes the adjacent member over an entire periphery of the outside face thereof, and wherein the first inclined part is provided over substantially the entire periphery of the outside face.

4. The switch device according to claim 1, wherein the adjacent member includes, at a lower edge part of a side face opposing the outside face of the operating knob, a cut face that widens in a tapered manner as it extends downwardly.

5. The switch device according to claim 4, wherein an angle formed by the cut face with respect to the direction of gravity is greater than an angle formed by the second inclined part with respect to the direction of gravity.

6. The switch device according to claim 2, wherein the second inclined part is immediately adjacent to, and continuous with the first inclined part.

7. The switch device of claim 1, wherein the operating knob has a stepped shape, including the outside face at an upper portion thereof, an outwardly tapered middle step portion defining the second inclined part and widening in a tapered shape as it extends downwardly from the upper step portion, and a lower step portion having a wide skirt shape extending vertically downwardly from the middle step portion.

8. The switch device of claim 1, wherein the switch device is configured and arranged such that in the event that a liquid enters the gap between the operating knob and the adjacent part, such liquid is routed downwardly and away from the operating knob.

9. A switch device comprising:

a panel having a hollow recessed part formed therein, the panel having an inner peripheral face which forms a side wall portion of the recessed part, a hollow case which is operatively attached to an underside of the panel, an operating knob which is supported by the case and which fits in the recessed part of the panel, the operating knob being selectively vertically movable in relation to the panel and the case, the operating knob having an upper step portion with a substantially vertical outside face, wherein a gap is formed between the inner peripheral face of the panel's hollow recess and the operating knob's outside face, the gap tapering outwardly as it extends downwardly.

10. The switch device of claim 9, wherein the switch device is configured and arranged such that in the event that a liquid enters the gap, such liquid is routed downwardly and away from the operating knob.

11. The switch device of claim 9, wherein the operating knob has a stepped shape, including the outside face at an upper portion thereof, an outwardly tapered middle step portion widening in a tapered shape as it extends downwardly from the upper step portion, and a lower step portion having a wide skirt shape extending vertically downwardly from the middle step portion.

* * * * *